US009576485B2

(12) United States Patent
Gao

(10) Patent No.: US 9,576,485 B2
(45) Date of Patent: Feb. 21, 2017

(54) STRETCHED INTERSECTION AND SIGNAL WARNING SYSTEM

(71) Applicant: Lijun Gao, Toledo, OH (US)

(72) Inventor: Lijun Gao, Toledo, OH (US)

( * ) Notice: Subject to any disclaimer, the term of this patent is extended or adjusted under 35 U.S.C. 154(b) by 164 days.

(21) Appl. No.: 14/335,144

(22) Filed: Jul. 18, 2014

(65) Prior Publication Data

US 2016/0019783 A1 Jan. 21, 2016

(51) Int. Cl.
*G08G 1/052* (2006.01)
*G08G 1/08* (2006.01)
*G08G 1/095* (2006.01)

(52) U.S. Cl.
CPC ..... *G08G 1/052* (2013.01); *G08G 1/08* (2013.01); *G08G 1/095* (2013.01)

(58) Field of Classification Search
CPC ..... G08G 1/095; G08G 1/096716; G08G 1/096758; G08G 1/04; G08G 1/042; G08G 1/052; G08G 1/0962; G08G 1/096783; G08G 1/0116; G08G 1/0133; G08G 1/0141; G08G 1/017; G08G 1/0175; G08G 1/056; G08G 1/09623; G08G 1/0965; G08G 1/096725; G08G 1/096775; G08G 1/096791; G08G 1/164; G08G 1/166; G08G 1/167; B60Q 2400/50; B60Q 1/302; B60Q 1/50; B60Q 9/008; B60Q 1/2611; B60Q 1/2665; B60Q 1/34; B60Q 1/52; B60Q 1/525; E01C 1/04; E01C 1/002; G01C 21/3658; G01C 21/26; G01C 21/3632; G01P 3/68; G01P 13/045; G01P 3/38; G01S 7/481; G02B 5/32; B60R 1/1207; E01F 15/00; G03B 21/00; G03H 1/0005; G03H 2001/2234; G03H 2001/2236; G03H 2001/2242;G03H 2222/34; G09F 19/18; G09F 2007/005; G09F 27/005; G09F 7/00; G09F 9/37; H04W 4/008
(Continued)

(56) References Cited

U.S. PATENT DOCUMENTS 3,847,496 A * 11/1974 Stankiewicz ..... E01C 1/04 404/1
4,590,455 A * 5/1986 Fritzinger ..... G08G 1/096 116/63 R
(Continued)

FOREIGN PATENT DOCUMENTS

KR 20080071108 A * 8/2008

OTHER PUBLICATIONS

Traffic Control Systems Handbook by Dunn Engineering Asociates in association with Siemens Intelligent Transportation Systems; Oct. 2005 Report No. FHWA-HOP-06-006 Dunn Engineering Associates, P.C. 66 Main Street Westhampton Beach, NY 11978.*

*Primary Examiner* — Fekadeselassie Girma

(57) ABSTRACT

One embodiment of a traffic intersection lane and signal system for improving intersection capacity and safety. Through traffic is stopped by signal means (22) a distance away from the intersection. Turning traffic on turn lanes (10) and (14) have an option to proceed and queue on lane segments (12) and (16) respectively, then complete the turning maneuvers during phase ϕ7 and phase ϕ1 respectively. The through traffic released from signal means (22) arrives at the intersection at the time opposing left turn phase ϕ5 expires and through phase ϕ6 starts, and passes through the intersection without significant delay. A set of detectors (50) and signal means (52) located before the presignal help drivers to make stop decisions, and another set of detectors (54) and signal means (56) located before the intersection provide last second warning to drivers who ran the red light
(Continued)

Compatible Phases and Sequence Diagram at the presignal. This system accommodates left-handed or right-handed driving conventions.

19 Claims, 8 Drawing Sheets

(58) Field of Classification Search
USPC ..... 340/907, 436, 905
See application file for complete search history.

(56) References Cited

U.S. PATENT DOCUMENTS 4,592,673 A * 6/1986 Lee ..... E01C 1/04 404/1
4,690,553 A * 9/1987 Fukamizu ..... G01W 1/14 250/341.8
5,917,622 A * 6/1999 Diffin ..... B60Q 1/302 359/15
5,963,345 A * 10/1999 Smith ..... B60Q 1/50 359/1
6,262,673 B1 * 7/2001 Kalina ..... G08G 1/095 340/901
6,269,304 B1 * 7/2001 Kaji ..... G01C 21/3658 342/70
8,101,903 B2 * 1/2012 Mokhnatyuk ..... H01L 27/14621 250/226
8,228,210 B2 * 7/2012 Sitbon ..... G08G 1/095 340/907
2004/0027828 A1 * 2/2004 Awa ..... G08G 1/095 362/259
2004/0036586 A1 * 2/2004 Harooni ..... B60Q 9/008 340/435
2005/0002203 A1 * 1/2005 Kojima ..... G09F 19/18 362/540
2005/0117364 A1 * 6/2005 Rennick ..... B60R 1/1207 362/540
2005/0268566 A1 * 12/2005 Park ..... E04H 6/10 52/173.1
2006/0267795 A1 * 11/2006 Draaijer ..... G08G 1/04 340/907
2007/0276600 A1 * 11/2007 King ..... G08G 1/042 701/301
2007/0296610 A1 * 12/2007 Heffernan ..... G08G 1/095 340/932
2008/0012726 A1 * 1/2008 Publicover ..... G08G 1/095 340/932
2008/0098633 A1 * 5/2008 Maruyama ..... G09F 9/37 40/463
2009/0224942 A1 * 9/2009 Goudy ..... G08G 1/164 340/905
2009/0273486 A1 * 11/2009 Sitbon ..... G08G 1/095 340/907
2011/0010228 A1 * 1/2011 Goto ..... G07B 15/063 705/13
2011/0054783 A1 * 3/2011 Kishikawa ..... G01C 21/3632 701/533
2011/0080306 A1 * 4/2011 Leopold ..... G01P 3/38 340/935
2011/0298603 A1 * 12/2011 King ..... G08G 1/164 340/436
2012/0044090 A1 * 2/2012 Kahler ..... B60Q 1/50 340/905
2013/0011190 A1 * 1/2013 Gingrich, Sr. ..... E01C 1/04 404/1
2013/0229644 A1 * 9/2013 Chung ..... G01S 17/88 356/5.01
2013/0271292 A1 * 10/2013 McDermott ..... G08G 1/096783 340/905
2014/0195138 A1 * 7/2014 Stelzig ..... G08G 1/0116 701/119
2015/0153184 A1 * 6/2015 Mudalige ..... G01C 21/26 701/523
2015/0348388 A1 * 12/2015 Teller ..... G06K 9/00671 340/937
2016/0148508 A1 * 5/2016 Morimoto ..... G08G 1/096 701/117

* cited by examiner

Signal means 56 Concept Illustration

Sign 58 Concept Illustration

Compatible Phases and Sequence Diagram

STRETCHED INTERSECTION AND SIGNAL WARNING SYSTEM

CROSS-REFERENCE TO RELATED APPLICATIONS

This application claims the benefit of provisional patent application Ser. No. 61/856,289, filed 2013 Jul. 19 by the present inventor.

FEDERALLY SPONSORED RESEARCH

Not Applicable

SEQUENCE LISTING OR PROGRAM

Not Applicable

BACKGROUND OF THE INVENTION

Field of Invention

This application relates to traffic intersections at grade specifically to an arrangement of lanes, detectors and traffic signal means.

Background of the Invention

Conventional traffic intersections with signal control have different movements of traffic (left turn, through and right turn) on the same approach all stop parallelly or side by side at the intersection at a red light until the traffic movements receive their turn of green light. A high volume of left turn traffic requires a long left turn signal phase and even warrants multiple dedicated turn lanes. Long left turn phases increase travel delay and more turn lanes create a wider intersection. A wider intersection will increase pedestrian crossing time and crossing distance through the intersection thus reducing pedestrian safety. A wider intersection also requires longer signal phasing clearance times (all red interval), and a longer pedestrian crossing time requires longer signal phase associated with the crossing. These will reduce intersection operational efficiency. Furthermore, right of way is not always available for widening the intersection.

Since all traffic stops and queues at the intersection for red light, when the green light starts, there is a startup delay due to driver's perception, reaction, and vehicle acceleration process. The startup delay is typically distributed to the first few queued vehicles. Also some drivers in the queue are not attentive to the signal change to green. The time headway between their vehicles and the preceding vehicles could be extra-large due to their late reaction.

When yellow light initiates at a conventional intersection, some through traffic drivers at a certain distance away from the intersection may have difficulty deciding whether to go or prepare to stop, and some through traffic drivers have a tendency to speed up to beat the upcoming red light. Severe accidents could happen if they did not make it.

Objects and Advantages

Accordingly several advantages of one or more aspects of current application, stretched intersection and signal warning system, are as follows:

Effectively utilize existing roadway surface by allowing turning traffic to discharge from the intersection via through lane segments besides the dedicated turn lanes; and reduce startup delay experienced by the first few vehicles of the through traffic and compress the through traffic time headway. Therefore, the stretched intersection and signal warning system can accommodate more traffic volumes compared with a conventional intersection with similar lane configurations.

Provide signal indication to through traffic at the start of the yellow light to help drivers to make stopping decisions. Provide signal indication to warn the through vehicles which have run the red light and give them a last chance to stop. Therefore, the stretched intersection and signal warning system are safer than a conventional intersection.

SUMMARY

In accordance with some embodiments of current application, the through movement traffic is stopped a distance away from an intersection at a red light by a presignal. Turning movement traffic can temporally utilize the through lane segments between the presignal and the intersection to make turning maneuvers. Queued through traffic receives green light at the presigal in advance and reach the intersection and catch the intersection green light at a preferred speed. This eliminates or reduces the startup delay and compresses time headways between discharging vehicles. Therefore, the capacity of the intersection is increased.

A signal indication in advance of the presignal is provided for through traffic to help drivers making stop decisions when the presignal yellow light starts. A signal indication is also provided for red-light-running drivers as a last second warning. The lane segments between the presignal and the intersection serve as a buffer zone for a red-light-runner to brake and stop before the intersection. Therefore, the safety of the intersection is improved.

DRAWINGS

Figures

In the drawings, closely related figures have the same number but different alphabetic suffixes.

DETAILED DESCRIPTION

FIG. 1—Prior Art

Figure 1:
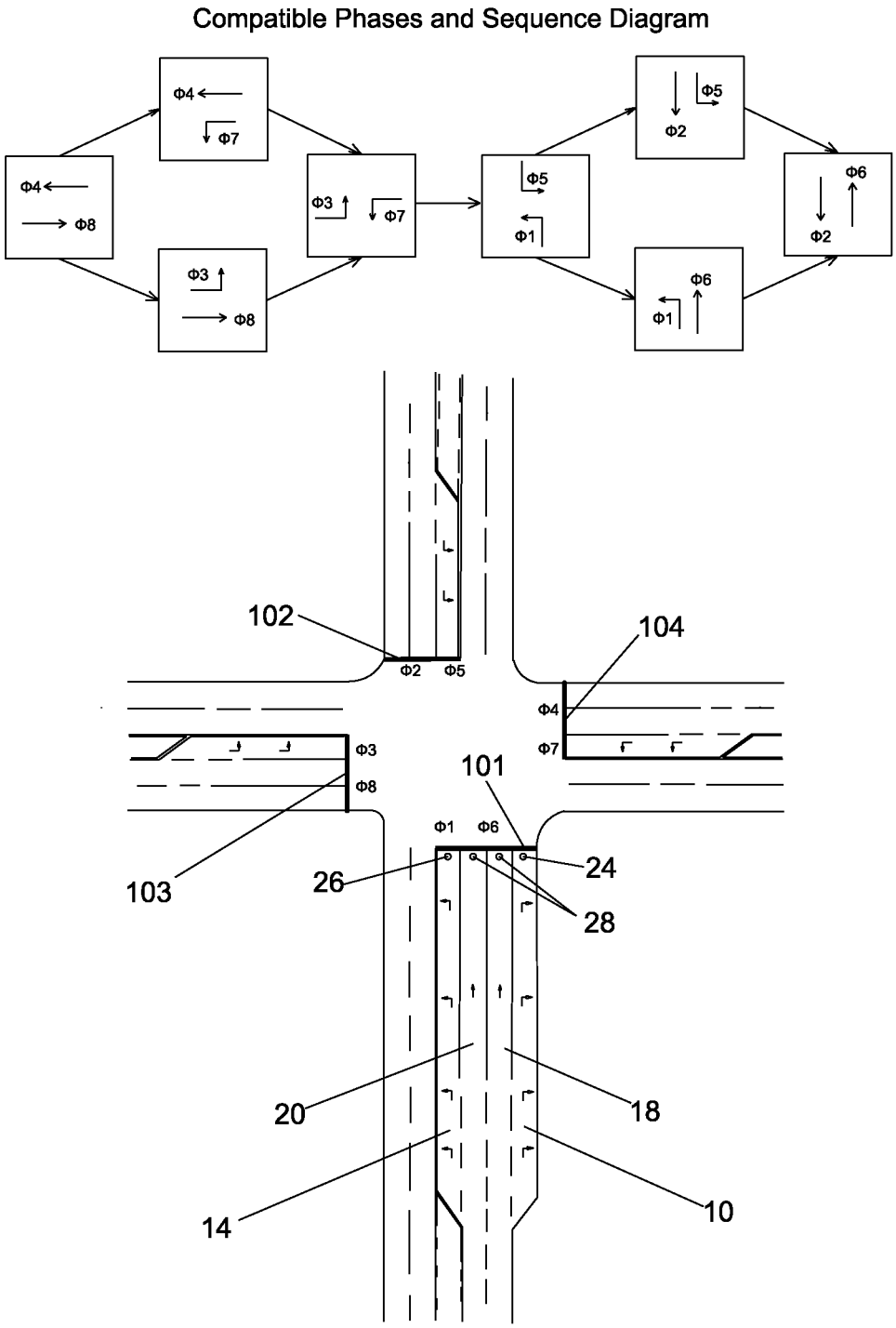
FIG. 1 PRIOR ART
FIG. 1 shows the prior art conventional intersection design.

A prior art, conventional eight-phase set intersection and its signal phase sequence are illustrated in FIG. 1. The conventional intersection design has different movements of traffic (left turn, through and right turn) on the same approach stop, queue and wait right at the intersection at the red light until they receive their turn of green light. At red light, northbound traffic stops at stop bar 101, southbound traffic stops at stop bar 102, eastbound traffic stops at stop bar 103, and westbound traffic stops at stop bar 104.

As the compatible phases and sequence diagram in FIG. 1 shows, east-west roadway signal has a "lag-lag" phase sequence. Eastbound left turn phase ϕ3 and westbound left turn phase ϕ7 start after opposing westbound through phase ϕ4 and eastbound through phase ϕ8 respectively. Through phase ϕ4 and ϕ8 start at the same time. Each through phase can end when the through demand is served. If eastbound through phase ϕ8 ends first, westbound left turn phase ϕ7 starts; if westbound through phase ϕ4 ends first, eastbound left turn phase ϕ3 starts. Phase ϕ3 and phase ϕ7 end at the same time.

The north-south roadway signal has a "lead-lead" phase sequence. Northbound left turn phase ϕ1 and southbound left turn phase ϕ5 start at the same time before opposing southbound through phase ϕ2 and northbound through phase ϕ6. Each left turn phase can end when the left turn demand is served. If northbound left turn phase ϕ1 ends first, southbound through phase ϕ2 starts; if southbound left turn phase ϕ5 ends first, northbound through phase ϕ6 starts.

The northbound approach of the conventional intersection comprises the following key elements: right turn lane 10; signal means 24 for controlling right turn traffic on lane 10; left turn lane 14; and signal means 26 for controlling left turn traffic on lane 14; through lane 18 and through lane 20; signal means 28 for controlling through traffic on lanes 18 and 20; the green interval of signal means 24 overlaps westbound left turn phase ϕ7; the green interval of signal means 26 represents northbound left turn phase ϕ1; and the green interval of signal means 28 represents northbound through phase ϕ6.

In all of the discussion above and in what follows, east-west, north-south, eastbound, southbound, westbound, and northbound are cited for convenience of visualization and are not to be construed as limiting this invention to roadways that parallel the points of the compass.

Figure 2A:
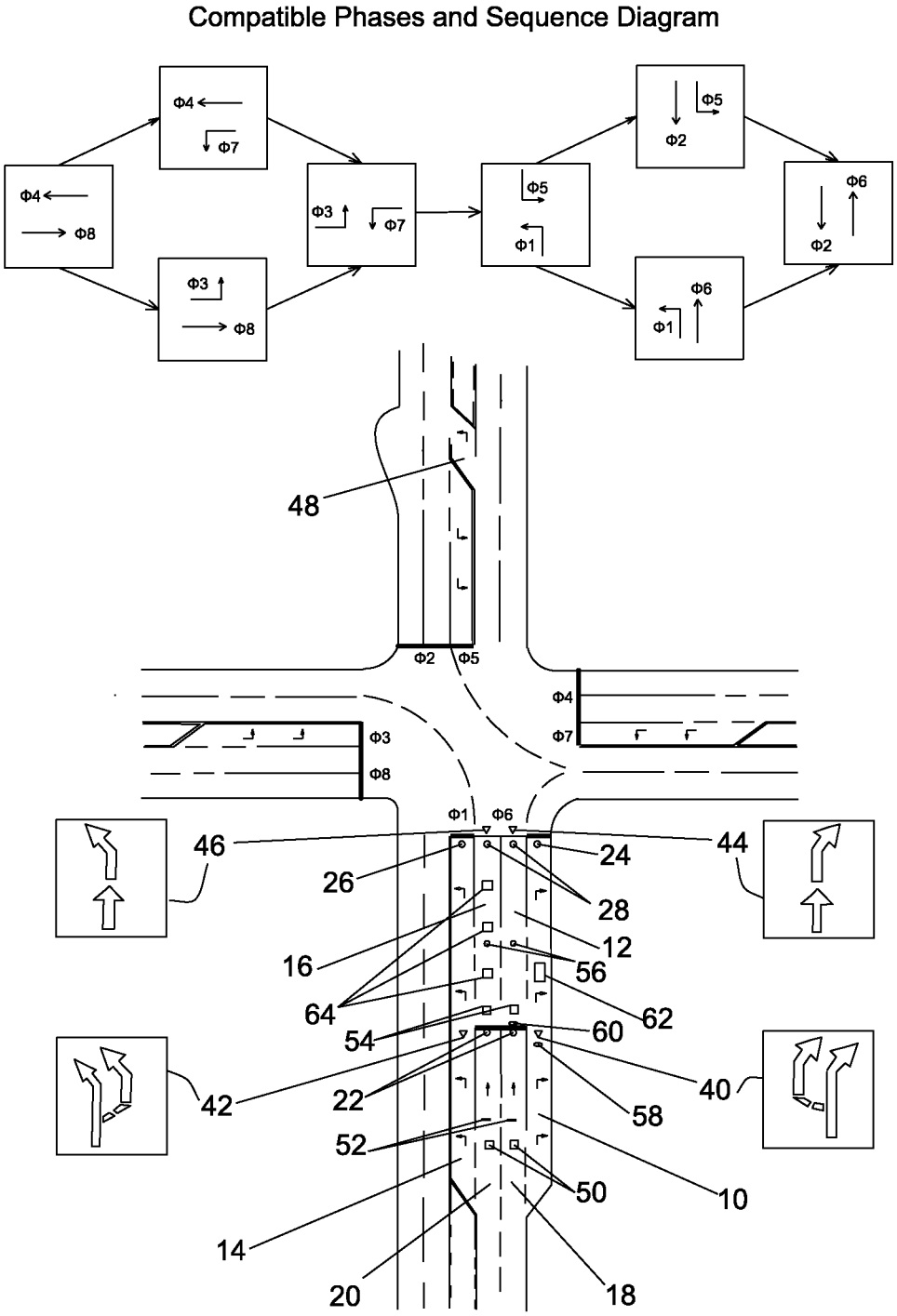
FIG. 2A shows one embodiment of stretched intersection and signal warning system.
Figure 2B:
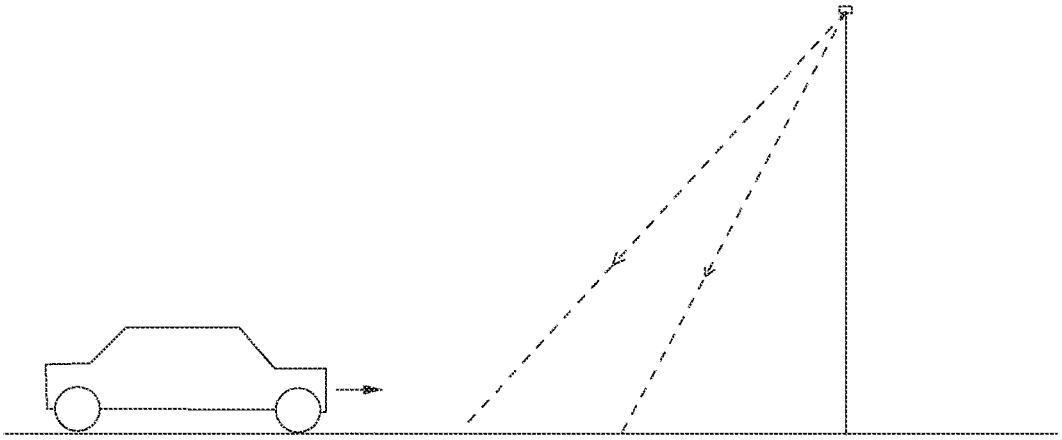
FIG. 2B shows the concepts of signal means and sign design used in stretched intersection and signal warning system.
Figure 2B:
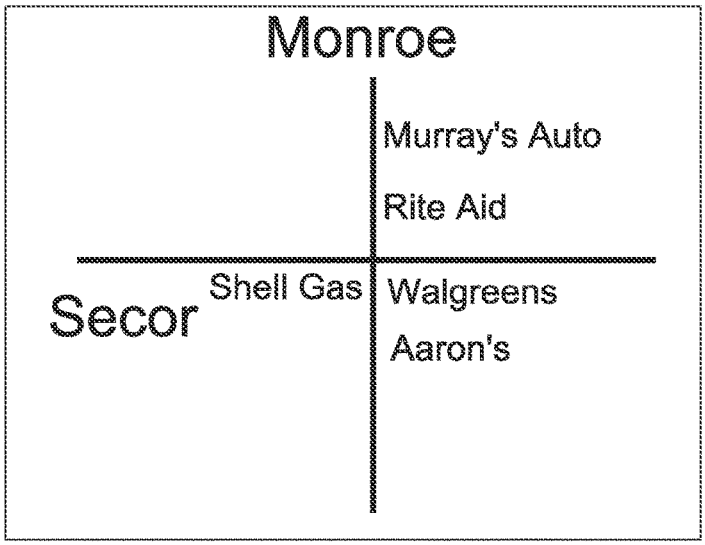

FIG. 2A and FIG. 2B—First Embodiment—Stretched Intersection and Signal Warning System FIG. 2A shows the first embodiment of the current application. The signal operation at the intersection has a typical eight-phase set. As the compatible phases and sequence diagram in FIG. 2A shows, north-south roadway has a "lead-lead" signal phase sequence and east-west roadway has a "lag-lag" signal phase sequence. The northbound approaching leg is configured with some of the features of stretched intersection and signal warning system.

Signal means 22, a presignal located in advance of the intersection, is for controlling through traffic on Lanes 18 and 20. Right turn lane 10 is for right turn traffic and buses. Lane segment 12 is a mixed use lane segment for right turn and through traffic. Signal means 24 is for controlling right turn traffic on lane 10 and lane segment 12.

Signal means 40 and 44 are for displaying the lane assignment of lane segment 12 as right turn lane or through lane. Signal means 40 and 44 can be a laser light that can downwardly project pavement marking onto the roadway surface. Signal means 40 and 44 can also be designed as overhead dynamic lane assignment signs as illustrated respectively in FIG. 2A.

Right turn traffic on lane 10 can enter lane segment 12 during red interval of signal means 22 and before green interval of signal means 24, each repeating cycle, while signal means 40 and 44 display the lane assignment of lane segment 12 as the right turn lane. Right turning traffic on lane segment 12 discharges and clears from the lane segment 12 during the green interval of signal means 24.

Lane 14 is for left turn traffic. Lane segment 16 is a mixed use lane segment for left turn and through traffic. Signal means 26 is for controlling left turn traffic on lane 14 and lane segment 16.

Signal means 42 and 46 are for displaying the lane assignment of lane segment 16 as left turn lane or through lane. Signal means 42 and 46 can be laser lights that can downwardly project pavement marking onto the pavement surface. Signal means 42 and 46 can also be designed as overhead dynamic lane assignment signs as illustrated respectively in FIG. 2A.

Left turn traffic on lane 14 can enter lane segment 16 during the red interval of signal means 22 and before green interval of signal means 26, each repeating cycle, while signal means 42 and 46 display the lane assignment of lane segment 16 as left turn lane. Left turning traffic on lane segment 16 discharges and clears from the lane segment 16 during the green interval of signal means 26.

Directional median opening 48, located on the northbound departure leg, offers an option for a left turning vehicle on lane segment 16 for whatever reason not served during the green interval of signal means 26 to make a U turn and then right turn to go west.

Through traffic on lane 18 and lane 20 enters lane segments 12 and 16 respectively during the green interval of signal means 22 while signal means 40, 44, 42 and 46 display the lane assignment of lane segments 12 and 16 as through lanes. Signal means 28 is for controlling through traffic on lane segments 12 and 16.

A dynamic speed limit sign 60 is used to inform drivers of a preferred speed to proceed forward to the intersection so that the queue does not need to stop and discharging time headways at the intersection can be minimized.

A street business name sign 58 is used to inform drivers of the name of the crossing street at the intersection and the businesses around the intersection so that drivers can know the information in advance. This will prevent drivers from getting distracted by these information points at the intersection and help to reduce the discharging time headways. The concept of the sign is illustrated in FIG. 2B.

The green interval of signal means 22 starts a few seconds earlier, and ends a few seconds earlier than the green interval of signal means 28 (phase ϕ6). This offset setting and the preferred speed displayed by the dynamic speed limit sign 60 allow the through traffic controlled by the signal means 22 on lanes 18 and 20 to reach the intersection just when the signal means 28 starts the green interval. This will eliminate or reduce startup delay typically experienced by the first few vehicles at a conventional intersection and minimize the discharging time headways between discharging vehicles. The offset also allows the through traffic to be cleared on lane segments 12 and 16 before the signal means 28 shows red indication (end of phase ϕ6).

A set of detectors 64 (in-ground or overhead) for lane segment 16 is used to detect the length of the traffic queue that stops on lane segment 16 before the start of the green interval of signal means 26 (or phase ϕ1) each repeating cycle. The detected queue length is used to calculate the minimum phase time for phase ϕ1 (minimum green interval of signal means 26) each repeating cycle.

The buses on lanes 18 and 20 can use lane 14 to make left turns, or use lane 10 to make right turns. To go straight, the buses have two options. Option one: stay on lanes 18 and 20 at the red light at the presignal and then go through at the green light. Option two: switch onto lane 10 to bypass the standing queue of through traffic at the presignal, then switch to lane segment 12 by following signal means 44 lane designation. The general right turning traffic should be excluded from using lane segment 12 to make a right turn when the bus volume is high. That will prevent the conflicting movements on lane segment 12 between the right turning traffic and the through buses. Option two provides the through buses a queue jumper without adding extra delay to the general traffic, like a conventional transit priority queue jumper would.

A near-side bus bay 62 located on the right turn lane is for buses that need boarding and alighting. After boarding and alighting, the buses at the bus bay can use the lane segment 12 to go north, and lane segment 16 to go west during certain time periods, each repeating cycle, by following signal means 44 and 46 respectively.

A signal warning system is integrated into the stretched intersection design. The system comprises a red light warning system and a stop warning system. The red light warning system comprises a set of detectors 50 and an overhead light source 52. The detector set is activated to measure the speeds of passing vehicles on each lane at the time the yellow indication starts at the presignal 22. The measured speeds are compared against a predetermined speed value. The predetermined speed is the minimum speed at which a vehicle can pass the presignal before the yellow light expires and the red light starts. The predetermined speed value is calculated from d/t, where d is the distance between light source 52 and the presignal, and t is the time left before the yellow light expires and the red light starts at the presignal. The predetermined speed value increases, further into the yellow interval of the presignal, as the yellow time left for a vehicle to pass the presignal gets less and the distance for the vehicle to travel remains the same. When a passing vehicle speed is lower than the predetermined speed, the overhead light source 52 illuminates and projects a downward facing light beam onto the windshield of the passing vehicles to indicate to the driver to prepare to stop.

The stop warning system comprises a set of detectors 54 and an overhead or roadside light source 56. The detector set is activated to measure the speeds of the passing vehicles on each lane after the start of the red interval of the presignal. A predetermined speed value is used to judge whether or not a vehicle intends to slow down and stop before the intersection. If the speed of the vehicle is above the predefined speed value, the light source 56 projects a message such as a "stop" word onto the roadway surface in front of the red light runner. The light source should be angled in a way that the light beam will be able to project onto the red light runner's windshield when the vehicle continues moving forward. The concept is illustrated in FIG. 2B. As the hologram technology advances, a 3D "stop" sign can be projected in the mid-air right in front of the upcoming red light running vehicle. The above described measure can be served as a last warning before the vehicle runs into the intersection, which could potentially cause a severe accident.

Operation of the Stretched Intersection—FIG. 2A

During signal phase ϕ8 of a repeating signal cycle at the intersection, the following traffic operations can occur for the northbound leg of the traffic intersection configured with the stretched intersection features:

1) Signal means 22 shows a red indication, a predetermined time before the end of signal phase ϕ6 (or start of phase ϕ8, start of the red interval of signal means 28) and stops the through traffic on lanes 18 and 20.
2) Signal means 28 shows a red indication.
3) Signal means 40 and 44 show indications to allow right turn traffic on lane 10 to enter lane segment 12 and signal means 42 and 46 show indications to allow left turn traffic on lane 14 to enter lane segment 16.
4) Buses stopped at bus bay 62 wishing to make a left turn can also enter lane segment 16.

During signal phase ϕ7 the following traffic operations can occur for the northbound leg:

5) Right turn traffic on lane 10 and lane segment 12 receives green indication from signal means 24 (the green interval of signal means 24 overlapping phase ϕ7) and discharge.
6) Signal means 40 and 44 show indications that lane segment 12 is closed for right turn traffic to enter and open for through traffic to enter. Right turning traffic already on lane segment 12 can continue to complete right turning.
7) Buses stopped at the bus bay 62 wishing to go north can enter the lane segment 12.

During signal phase ϕ1 the following traffic operations can occur for the northbound leg:

8) Left turn traffic on lane 14 and lane segment 16 receive green indication from signal means 26 and discharge.
9) Signal means 42 and 46 show indications that that lane segment 16 is closed for left turn traffic to enter and open for through traffic to enter. Left turning traffic (cars and buses) already queued on lane segment 16 can continue to complete left turning.
10) At the end of phase ϕ1, all left turning traffic on lane segment 16 should be totally discharged and cleared. Signal means 26 shows red indication and the uncleared left turning traffic on lane 14 is stopped.

During signal phase ϕ5 the following traffic operations can occur for the northbound leg:

11) Through traffic on lane 18 and lane 20 receives green indication from signal means 22, a predetermined time before the end of phase ϕ5 (or start of phase ϕ6, green indication of signal means 28) and moves onto lane segments 12 and 16 (the left turning traffic on lane segment 16 in phase ϕ1 is cleared or being cleared).

During signal phase ϕ6 the following traffic operations can occur for the northbound leg:

12) Signal means 28 shows green indication to discharge through traffic arriving from the presignal (signal means 22).
13) If there are buses queued at segment 12 to go north, the buses are discharged through the intersection ahead of through traffic arriving from the presignal initially on lane 18
14) At a predetermined time before the end of signal phase ϕ6, though traffic on lanes 18 and 20 receive the red indication from signal means 22 and are stopped at the presignal.
15) At the end of phase ϕ6, through traffic on lane segments 12 and 16 should be totally discharged and cleared.

Figure 3:
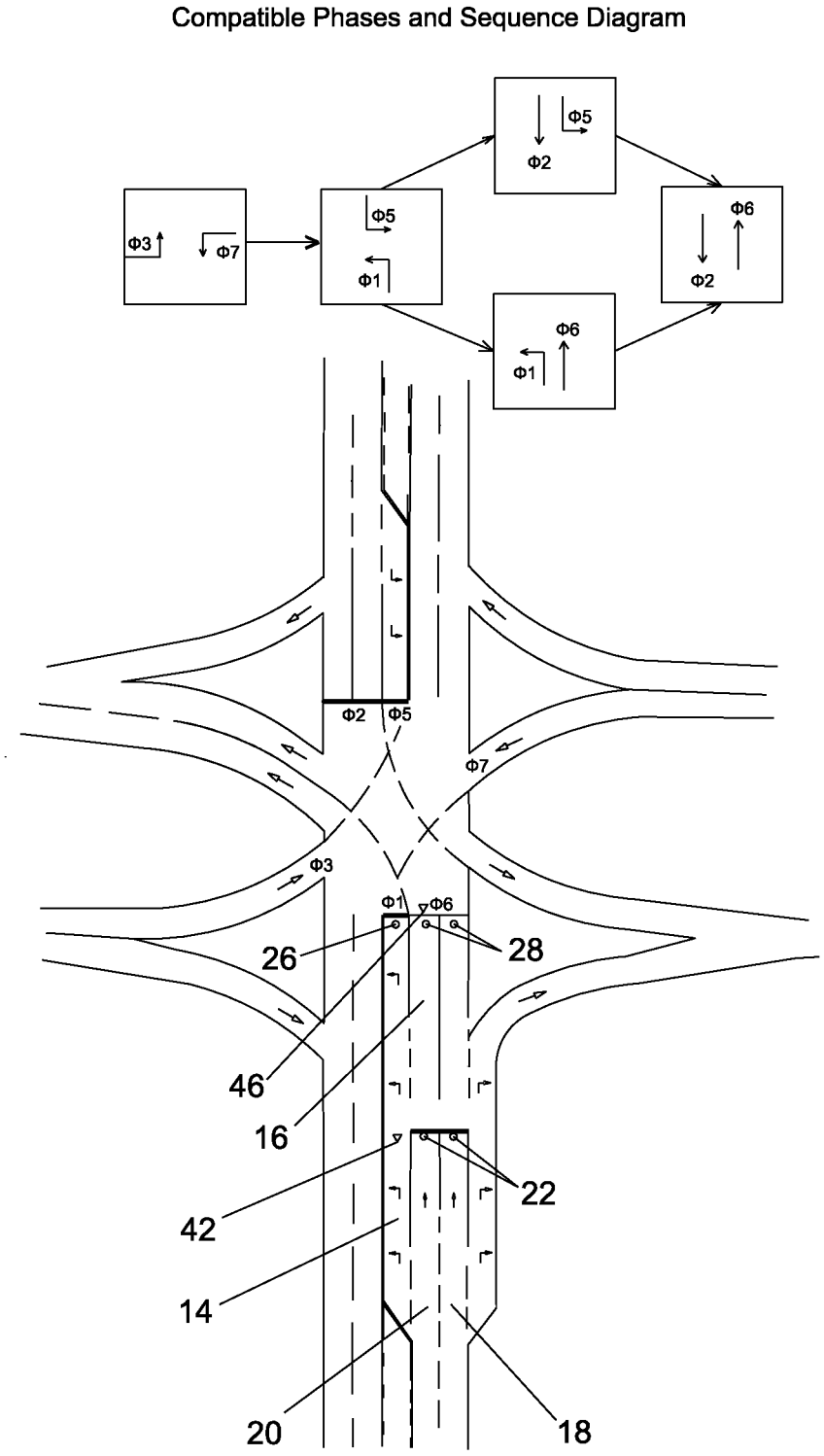
FIG. 3 shows the stretched single point urban interchange embodiment.

FIG. 3—Additional Embodiment—Stretched SPUI

FIG. 3 shows another embodiment of the stretched intersection design as applied to northbound leg of a traditional SPUI (single point urban interchange). Phases ϕ3 and ϕ7 start and end at the same time and belong to one phase set, as illustrated in the compatible phases and sequence diagram in FIG. 3. During phases ϕ3 and ϕ7 through traffic on lanes 18 and 20 are stopped by signal means 22, left turn traffic on lane 14 can enter and queue on lane segment 16. During phase ϕ1 (green interval of signal means 26), left turn traffic can make left turning maneuvers using both lane 14 and lane segment 16, signal means 42 and 46 display indications that lane segment 16 is closed for left turn traffic to enter and open for through traffic to enter after start of phase ϕ1. At the end of phase ϕ1, left turn traffic on lane segment 16 should be totally discharged and cleared.

Through traffic queued on lanes 18 and 20 receives a green signal from signal means 22 at a predetermined time before phase ϕ5 ends, and reaches the intersection at the start of phase ϕ6 (the start of the green interval of signal means 28) at a preferred speed. The green interval of signal means 22 ends at a predetermined time before the end of the green interval of signal means 28 so that all through traffic on lane segment 16 can be discharged and cleared during phase ϕ6 each repeating cycle.

Figure 4:
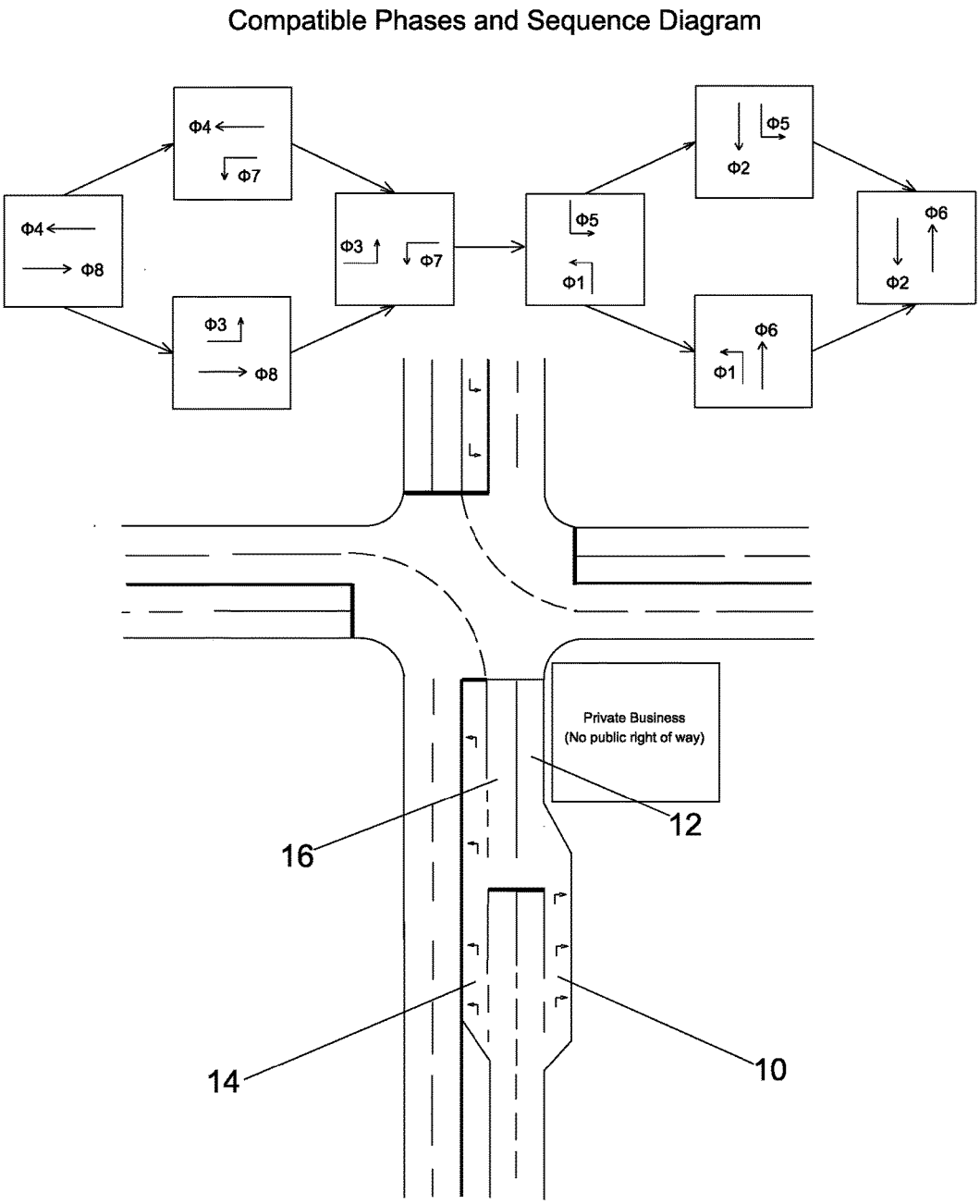
FIG. 4 shows another embodiment of stretched intersection with limited right of way.

FIG. 4—Additional Embodiment—Stretched Intersection with Limited Right of Way FIG. 4 shows another embodiment of the stretched intersection design as applied to northbound leg of a conventional traffic intersection. The main traffic signal at the intersection has a typical eight-phase set, with a "lag-lag" phase sequence for the east-west roadway and a "lead-lead" phase for the north-south roadway. There is a significant amount of north bound right turn traffic that requires a dedicated right turn lane. There is a business located at the southeast corner of this intersection, and there is no right of way for a right turn lane at this corner of the intersection.

However, there is a right of way further south of the corner to build a right turn lane 10. The stretched intersection design allows the right turners on lane 10 to enter lane segment 12 during the intersection signal phase ϕ8 and make right turning maneuvers during phase ϕ7 by stopping the through traffic in advance of the intersection. The left turners on left turn lane 14 can enter lane segment 16 during phase ϕ8 and phase ϕ7, and make left turning maneuvers and be cleared from the lane segment 16 during phase ϕ1.

Figure 5:
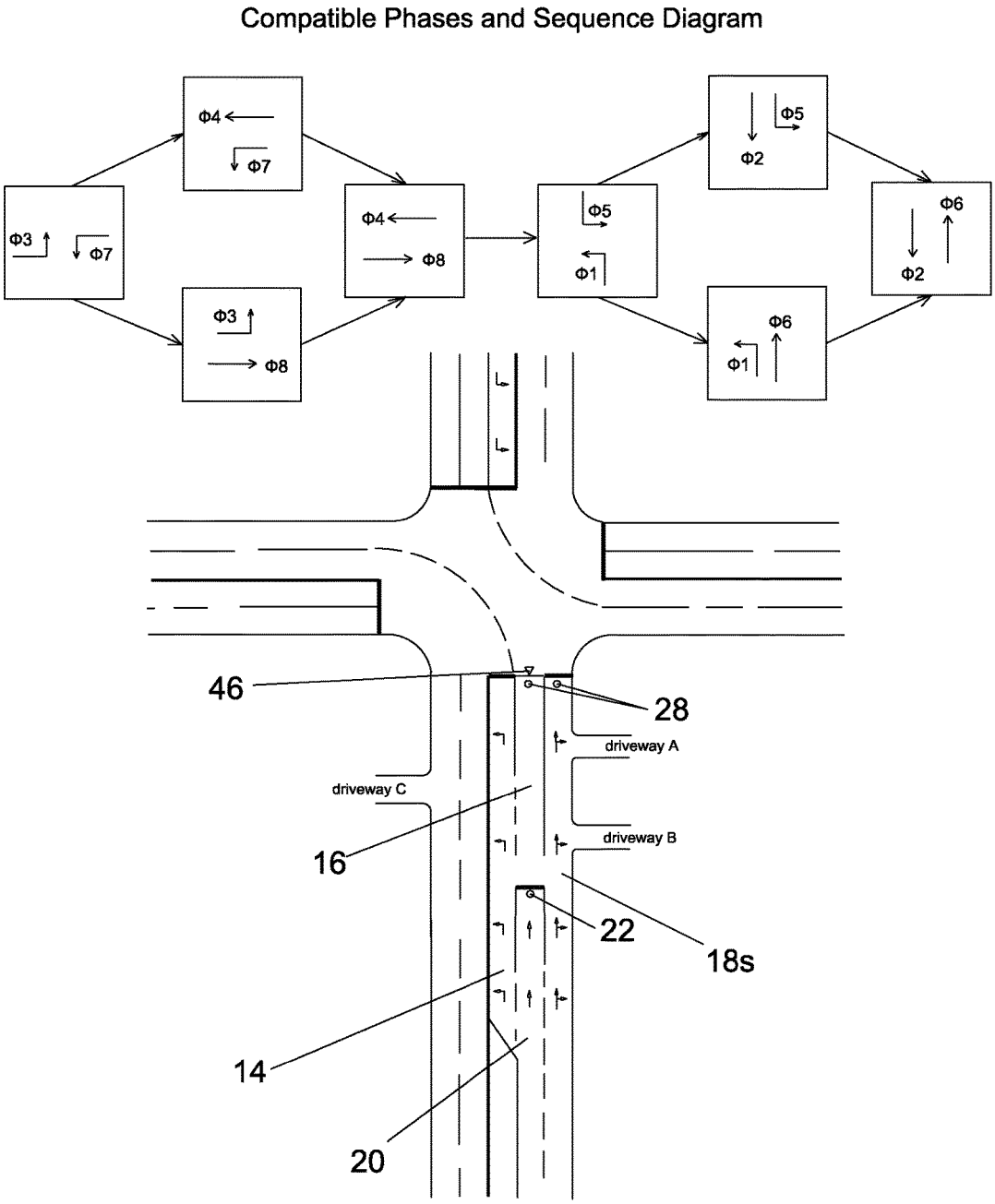
FIG. 5 shows another embodiment of stretched intersection with multiple driveways near the intersection.

FIG. 5—Additional Embodiment—Stretched Intersection with Multiple Driveways

FIG. 5 shows another embodiment of the stretched intersection design as applied to the northbound leg of an intersection. The main traffic signal at the intersection has a typical eight phase set with a "lead-lead" phase sequence for both north-south roadway and east-west roadway. There is no right of way to build a dedicated right turn lane for the northbound approaching leg. There are two business driveways (driveway A and B) located along the northbound leg. Some traffic turns into these two driveways. A portion of through traffic—through traffic on lane 20 is controlled by signal means 22; Lane 18*s* is shared by through and right turn traffic. All traffic on lane 18*s* is controlled by signal means 28 and stops at the intersection at the red light. This setting allows the traffic wishing to enter driveway A and B an early chance to do so. The exiting traffic from driveway A and B wishing to go west needs to look for the signal means 46 to identify lane assignment for lane segment 16 to use it as a left lane each repeating signal cycle. The exiting traffic from driveway A and B wishing to go west can also use the dedicated left turn lane 14.

The exiting traffic from driveway A and B wishing to go north uses lane 18*s*. The exiting traffic from driveway A and B wishing to go north can also use lane segment 16 during a certain time period each repeating signal cycle by observing signal means 46 to identify lane assignment for lane segment 16 to use it as a through lane. For exiting traffic from the driveway A and B wishing to go south, it would be easier and safer for them to do so as traffic on one of the through lanes is stopped upstream at red light.

The exiting traffic from driveway C wishing to go west can use lane 14 to make left turning maneuvers or lane segment 16 by following the signal means 46 for lane assignment in order to use it as a left turn lane. The exiting traffic from driveway C wishing to go north can use lane 18*s* or lane segment 16 by following the signal means 46 for lane assignment to use it as a through lane. The exiting traffic from driveway C wishing to go east can use lane 18*s*.

Figure 6:
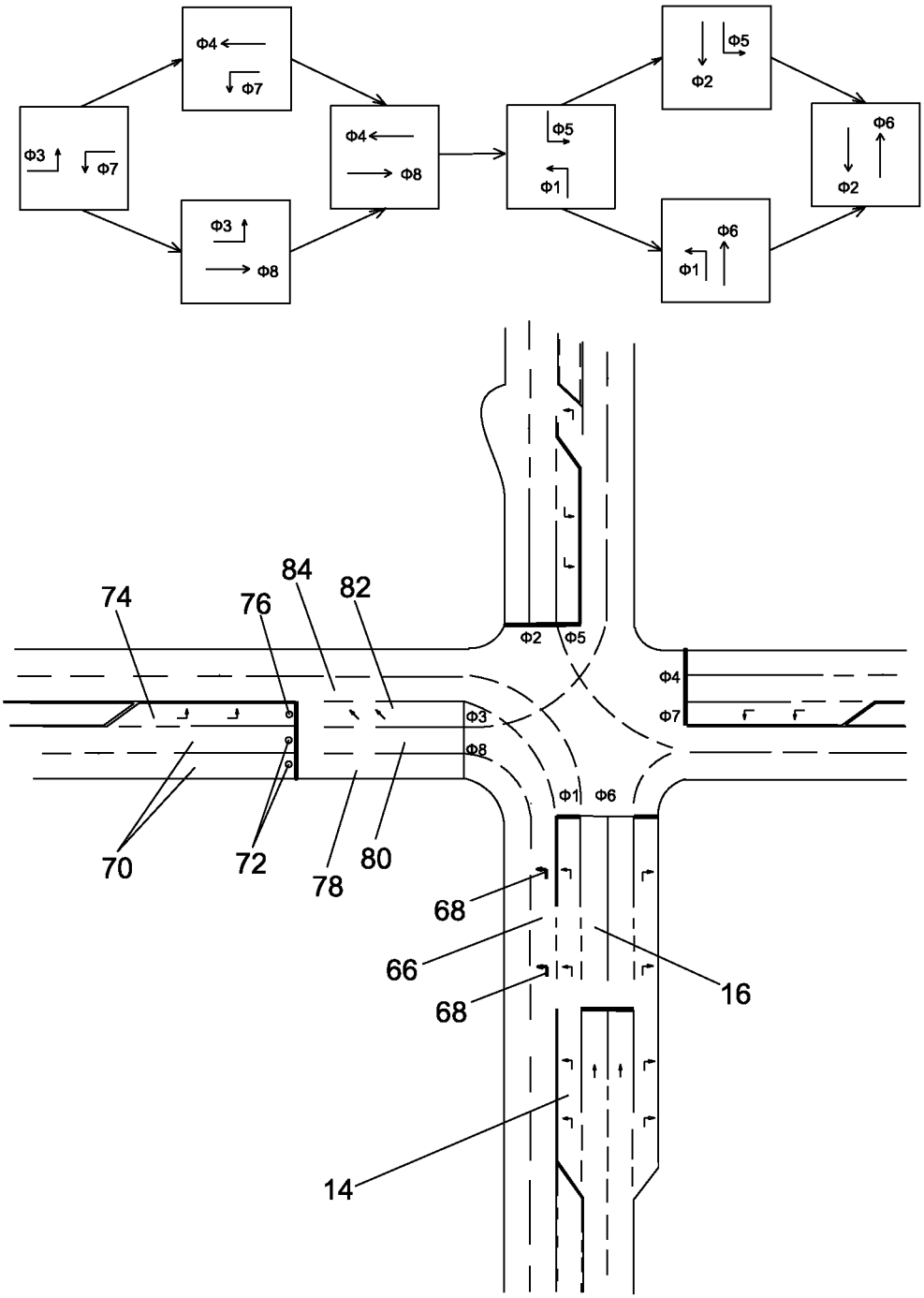
FIG. 6 shows another embodiment of stretched intersection to accommodate high left turn traffic.

FIG. 6—Additional Embodiment—Stretched Intersection with Heavy Left Turn Traffic FIG. 6 shows another embodiment of the stretched intersection design as applied to the northbound leg and the eastbound leg of a traffic intersection. The intersection traffic signal operates with a typical eight phase set. As the compatible phases and sequence diagram shows, both north-south roadway and east-west roadway have "lead-lead" phase sequences. Northbound left turn phase ϕ1 and southbound left turn phase ϕ5 start at the same time before opposing southbound through phase ϕ2 and northbound through phase ϕ6. Eastbound left turn phase ϕ3 and westbound left turn phase ϕ7 start at the same time before opposing westbound through phase ϕ4 and eastbound through phase ϕ8.

Signal means 72 and 76 are located on the eastbound approaching leg at a predetermined location from the intersection. Traffic on lanes 70 and lane 74 is controlled by signal means 72 and signal means 76 respectively.

A few seconds after phase ϕ2 starts, left turn traffic on lane 74 receives green indication from signal means 76 and enters lane segments 82 and 80, discharges and clears from lane segments 82 and 80 during phase ϕ3. The through traffic on lanes 70 receives green indication of signal means 72 before the end of phase ϕ7 or before the start of phase ϕ8, moves onto lane segments 78 and 80 at a preferred speed, discharges and clears from the lane segments during phase ϕ8 without stopping at the intersection. During phase ϕ1 each repeating signal cycle, lane segments 80 and 82 are clear from traffic originated from lanes 70 and 74

Left turn traffic on lane 14 can enter lane segment 16 during phase ϕ7 and phase ϕ8, make left turn maneuvers and clear from lane segment 16 during phase ϕ1.

Left turn traffic on lane 14 can enter lane 66 a few seconds after phase ϕ8 starts; in-ground signal means 68 shows the indication when left turn traffic can enter the lane. During phase ϕ1, the left turn traffic on lane 66 makes left turn maneuvers and clears from the lane 66, and enters lane segment 82 (clear from traffic originated from lanes 70 and 74), and from there merges to the right onto departure lane 84.

The above embodiment demonstrates how three lane left turning capacity is achieved by utilizing lane 66 and lane segment 82.

Figure 7:
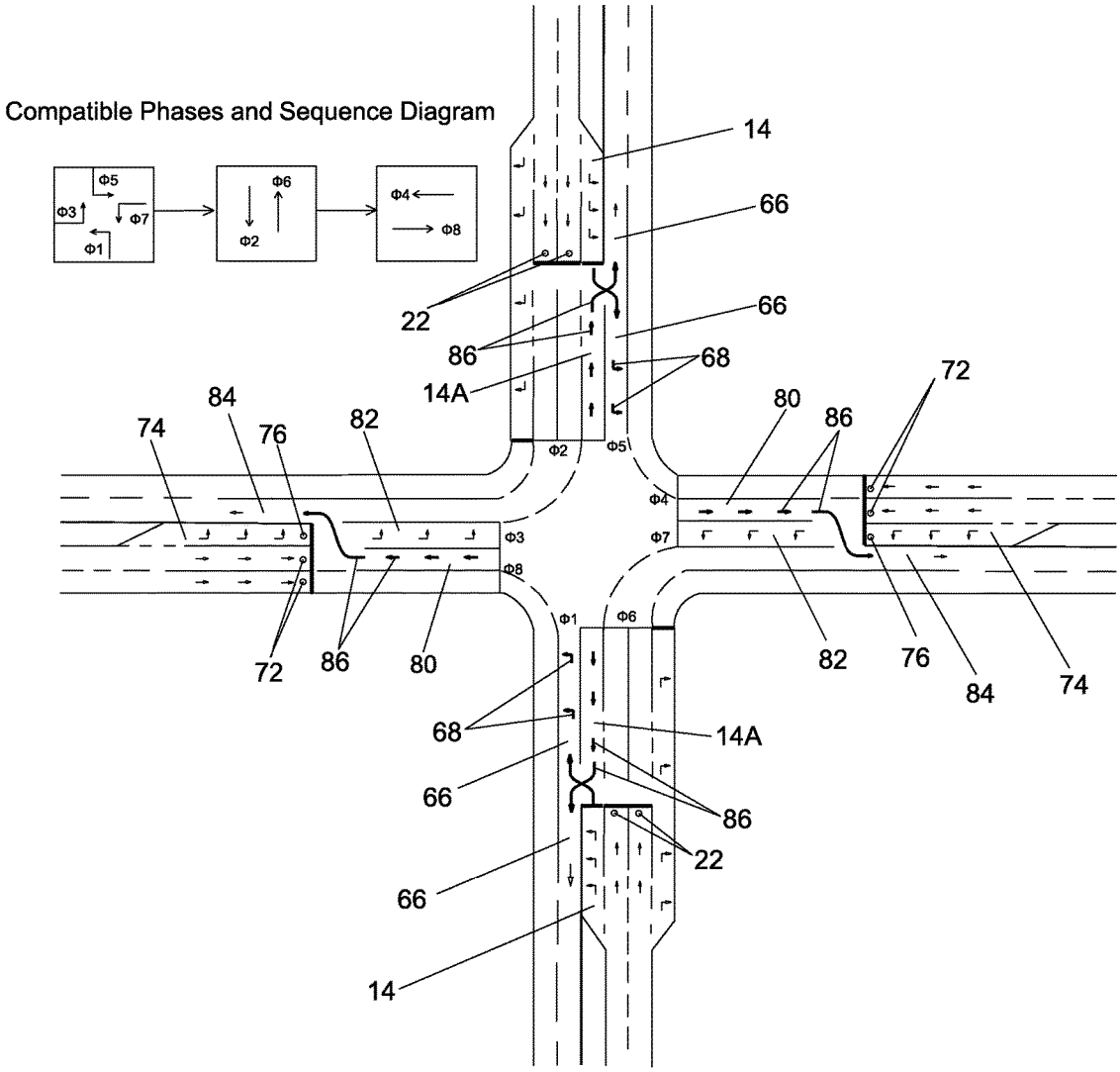
FIG. 7 shows a three phase set stretched intersection embodiment.

FIG. 7—Additional Embodiment—Three Phase Set Stretched Intersection

FIG. 7 shows another embodiment of the stretched intersection design as applied to the four legs of an intersection;

four left turn movements start and end at the same time and they are represented by the phases ϕ1, ϕ3, ϕ5 and ϕ7 respectively. Phases ϕ1, ϕ3, ϕ5 and ϕ7 belong to one phase set as illustrated in the compatible phases and sequence diagram in FIG. 7. Also, northbound through (ϕ6) movement and southbound through (ϕ2) movement start and end at the same time and belong to one phase set. Eastbound through (ϕ8) movement and westbound through (ϕ4) movement start and end at the same time and belong to one phase set.

Before the end of the left turn movements phase set, northbound and southbound through traffic receive green indication from signal means 22, and start to move to the intersection. When the northbound and southbound through traffic reach the intersection, the left turn phase ϕ1, ϕ3, ϕ5, and ϕ7 have already ended. The phase ϕ6 and ϕ2 start, the northbound and southbound through traffic discharge through the intersection without stopping. The green interval of signal means 22 ends a few seconds before the end of phase ϕ6 and ϕ2 so that no through traffic is stopped between signal means 22 and the intersection.

Before the end of the phase ϕ6 and ϕ2, eastbound and westbound through traffic receive green indication from signal means 72, and start to move to the intersection. When the eastbound and westbound through traffic reach the intersection, the phases ϕ6 and ϕ2 have already ended. The phases ϕ8 and ϕ4 start, and the eastbound and westbound through traffic discharge through the intersection without stopping. The green interval of signal means 72 ends a few seconds before the end of phase ϕ8 and ϕ4 so that no through traffic is stopped between signal means 72 and the intersection.

At the start of phases ϕ8 and ϕ4, both eastbound left turn traffic and westbound left turn traffic on lanes 74 receive green indication from signal means 76 and move onto lane segments 82.

A few seconds after the start of phases ϕ8 and ϕ4, northbound left turn traffic and southbound left turn traffic on lanes 14 receive indication from in-ground signal means 68 and move onto lanes 66.

During phases ϕ1, ϕ3, ϕ5, and ϕ7, northbound and southbound left turn traffic on lanes 66 left turn onto lane segments 80 and shift onto departure lanes 84 by following in-ground signal means 86; eastbound and westbound left turn traffic on segments 82 turn left onto lane segments 14A and shift onto departure lanes 66 by following in-ground signal means 86.

The above embodiment demonstrates how all left turn movements can be conducted in one phase set, and three phase sets in total to serve all traffic movements.

ADVANTAGES

From the descriptions above, several advantages of some embodiments of this application become evident:

(a) Capacity Increase: Compared with a conventional signalized intersection design with similar lane configurations, the stretched intersection increases the intersection capacity by utilizing through lane segments to discharge turning traffic. The stretched intersection can optimize the intersection discharging speeds of the through traffic initially queued at the presignal. The advance street and business sign informs drivers of information points ahead of them. These will reduce the startup delay and the time headways between vehicles and further increase intersection capacity. The stretched intersection is also able to provide transit-priority-queue-jumper without penalizing the general traffic.

(b) Safety Improvement: Conventional intersection improvements are to widen the intersection and add new lanes to accommodate higher traffic volumes. A wider intersection will increase pedestrian crossing time and crossing distance and reduce pedestrian safety. The stretched intersection can accommodate comparable high traffic volumes with fewer lanes and a narrower intersection, thus resulting in a safer pedestrian crossing. In some embodiments of the stretched intersection, the through traffic stops in advance of the intersection at a presignal at the red light. The through signal offset between the presignal and the main signal of the intersection is appropriately programmed to reduce red light running violations. The integrated red light warning system can provide indications to help drivers to make a stop decision to prevent red light running The integrated stop warning system can provide a last second warning to drivers who did not notice and have run the red light at the presignal. The lane segment between the presignal and intersection can serve as a buffer zone for drivers who have run the red light at the presignal to brake and stop before the intersection.

(c) Low Cost and Convenience of Construction: To retrofit an existing conventional intersection, the lane segments required by the stretched intersection design already exist or the right of way to construct those lane segments is usually available. The cost will be much lower than widening the intersection to add lanes. The main signal at the intersection requires minimal additions and modification. The construction activities will have less impact to the existing traffic flow compared with other improvements because the primary add-on is in advance of the intersection. The existing coordinated signal timing plan does not need major changes if the retrofitted intersection belongs to a coordinated arterial corridor.

(d) Wide Applicability: The stretched intersection design reduces delay for high volume, congested intersections as well as low volume, uncongested intersections. The length of the lane segments between the presignal and the intersection is flexible and determined based on factors such as traffic volumes, driveways location, queue length, and queue storage length. This invention is irrespective of direction of travel, therefore right-handed travel such as in the United States and left-handed travel such as in the United Kingdom are irrelevant. However, for convenience of description, all embodiments and description follow the right-handed conventions.

CONCLUSION, RAMIFICATION AND SCOPE

Accordingly, the reader will understand that the stretched intersection and signal warning system, when applied to a traffic intersection, whether it is congested or not, can provide substantial travel delay savings over more costly conventional improvements. The integrated signal warning system and the unique lane configuration and settings of the stretched intersection will greatly reduce the rates of red light violations and severe accidents. There will be no or substantially fewer impacts to private property or protected resources than traditional capacity improvement projects. There will be no or minimal new pavement construction when retrofitting an existing conventional intersection. Construction and modification can take place with minor interruptions to traffic operation, and minimal modification to the existing traffic signal setting at the existing intersection.

Although the figures and description above contain many specificities, these should not be construed as limiting the scope of the invention, but as merely providing illustrations of some of the presently preferred embodiments of this invention. For example, the intersection can be configured in many different ways based on the number of approaching legs of the intersection, number of lanes of the approaching leg, varying angle of approaching legs, the signal phasing sequence, number and length of mixed-use lane segments, right hand or left hand direction of travel, etc. The features of this invention can be applied to one or multiple legs of an intersection. Thus, the scope of the invention should be determined by the appended claims and the legal equivalents, rather than the examples given.

I claim:

1. A traffic intersection lane and signal system comprising:

a) a traffic intersection, b) a first signal means and associated first stop bar located near said traffic intersection for each approaching leg of said traffic intersection, c) at least one approaching leg of said traffic intersection further comprising the following features and characteristics:

i. a second signal means and associated second stop bar located a distance away from before said traffic intersection on said at least one approaching leg, ii. at least one traffic lanes approaching and passing beyond said second signal means on said at least one approaching leg, iii. one or more mixed use lane segments between said first signal means and said second signal means, d) one or more groups of traffic to discharge from said traffic intersection, e) one or more other groups of traffic to discharge from said traffic intersection, and f) means of a repeating signal cycle for said one or more mixed use lane segments to discharge said one or more groups of traffic and said one or more other groups of traffic alternately, whereby said traffic intersection lane and signal system effectively utilize roadway surface to increase intersection capacity and reduce delay.

2. The traffic intersection lane and signal system of claim 1, further including signal means to show an indication of which group of traffic can enter said mixed-use lane segments.

3. The traffic intersection lane and signal system of claim 2, wherein said signal means are laser lights that can downwardly project pavement marking onto the pavement.

4. The traffic intersection lane and signal system of claim 2, wherein said signal means are overhead dynamic lane assignment signs.

5. The traffic intersection lane and signal system of claim 2, wherein said signal means are signals embedded in pavement surface.

6. The traffic intersection lane and signal system of claim 1, further including means to detect the length of a traffic queue on said one or more mixed use lane segments.

7. The traffic intersection lane and signal system of claim 1, further including a dynamic speed limit sign to inform drivers of a preferred speed to proceed forward to said traffic intersection, whereby the discharging headways at said traffic intersection can be reduced.

8. The traffic intersection lane and signal system of claim 1, further including a U-turn crossover and a bulb-out or loons on one or more departure legs of said traffic intersection, whereby some turning traffic may use said U-turn crossover and said bulb-out or loons to make a U-turn.

9. The traffic intersection lane and signal system of claim 1, further including street business signs located in advance of said traffic intersection, whereby the names of the upcoming crossing street and businesses around said traffic intersection are conveyed to drivers in advance.

10. The traffic intersection lane and signal system of claim 1, further including a red light warning system comprising:

a) a detection means for measuring an upcoming vehicle speed, b) a signal means to illuminate and project a downward light beam when said vehicle speed is below a predetermined value, whereby an indication is conveyed to the driver of said vehicle to advise him or her to prepare to stop for an upcoming red light.

11. The traffic intersection lane and signal system of claim 1, further including a stop warning system comprising:

a) a detection means to measure an upcoming vehicle speed, b) a signal means to project a message onto pavement or midair when said vehicle speed is above a predetermined value, whereby a last second warning message is issued to the driver of said vehicle to stop him or her from running the red light of said traffic intersection.

12. The traffic intersection lane and signal system of claim 1, wherein said traffic intersection is a single point urban interchange.

13. The traffic intersection lane and signal system of claim 1, wherein said one or more groups of traffic are through traffic, and said one or more other groups of traffic are left turn and right turn traffic.

14. The traffic intersection lane and signal system of claim 11, wherein said one or more groups of traffic are through traffic, and said one or more other groups of traffic are left turn or right turn traffic.

15. The traffic intersection lane and signal system of claim 1, wherein said one or more groups of traffic are a portion of through traffic, and said one or more other groups of traffic are left turn or right turn traffic.

16. The traffic intersection lane and signal system of claim 1, wherein said one or more groups of traffic are turn traffic and through traffic, and said one or more other groups of traffic are turn traffic received from the adjacent approaching legs of said traffic intersection.

17. The traffic intersection lane and signal system of claim 1, wherein said one or more groups of traffic are through traffic, and said one or more other groups of traffic are buses.

18. The traffic intersection lane and signal system of claim 1, further including a transit station queue jumper comprising:

a) a transit station located near said traffic intersection, b) means for buses stopped at said transit station to discharge on said one or more mixed use lane segments from said traffic intersection ahead of the general traffic, whereby buses are given priority to discharge from said traffic intersection without penalizing the general traffic.

19. A traffic intersection lane and signal system comprising:

a) a traffic intersection, b) a first signal means and associated first stop bar located near said traffic intersection for each approaching leg of said traffic intersection, c) at least one approaching leg of said traffic intersection further comprising the following features and characteristics:

i. a second signal means and associated second stop bar located a distance away from before said traffic intersection on said at least one approaching leg, ii. one or more mixed use lane segments between said first signal means and said second signal means, iii. one or more groups of traffic on one or more lanes of said at least one approaching leg to discharge from said traffic intersection, iv. one or more other groups of traffic on one or more other lanes of said at least one approaching leg to discharge from said traffic intersection, v. said one or more groups of traffic on said one or more lanes stops at said second stop bar when receiving a red light from said second signal means, vi. said one or more other groups of traffic on said one or more other lanes stops at said first stop bar when receiving a red light from said first signal means, vii. said traffic intersection lane and signal system further comprising the following steps:

1) when said one or more groups of traffic on said one or more lanes stops at said second stop bar, said one or more other groups of traffic on said one or more other lanes may enter said mixed use lane segments and discharge from said traffic intersection when receiving a green light from said first signal means, 2) said one or more groups of traffic receive a green light from said second signal means, move onto said mixed use lane segments and discharge from said traffic intersection without stopping at said first signal means, 3) said second signal means green light ends a predetermined time earlier than said first signal means green light for said one or more groups of traffic so that said one or more groups of traffic can clear from said mixed use lane segments and said one or more other groups of traffic may utilize said mixed use lane segments in the next signal cycle, 4) 1), 2), and 3) repeat in each signal cycle of said traffic intersection, whereby said traffic intersection lane and signal system effectively utilize roadway surface, reduce delay and increase intersection capacity.

* * * * *